US005428907A

United States Patent [19]

Haslbeck et al.

[11] Patent Number: 5,428,907

[45] Date of Patent: Jul. 4, 1995

[54] DOWNCOMER AND FLAPPER VALVE

[75] Inventors: John L. Haslbeck, Pittsburgh, Pa.; Carroll H. Sherman, Streetsboro, Ohio; Scott M. Harkins, Pittsburgh, Pa.

[73] Assignee: NOXSO Corporation, Bethel Park, Pa.

[21] Appl. No.: 285,103

[22] Filed: Aug. 3, 1994

[51] Int. Cl.[6] ..... F26B 25/00

[52] U.S. Cl. ..... 34/588; 34/579; 34/364; 34/369; 137/527.6; 137/527.8

[58] Field of Search ..... 137/527.6, 527.8; 34/579, 588, 364, 369

[56] References Cited

U.S. PATENT DOCUMENTS 4,074,691 2/1978 Luckenbach ..... 137/382

4,184,662 1/1980 Feldman ..... 251/82

*Primary Examiner*—Henry Bennett

*Assistant Examiner*—Siddharth Ohri

*Attorney, Agent, or Firm*—R. Gale Rhodes, Jr.

[57] ABSTRACT

A downcomer including a tubular member oriented vertically and extending downwardly from a fluidized grid and including a lower portion provided with an inclined opening formed at a first angle with respect to the tubular member, and a flapper valve including an upper portion and a lower portion formed at a second angle with respect to the upper valve portion, the upper portion of the flapper valve is mounted pivotally to the tubular member at a position to normally place the lower portion of the flapper valve in engagement with and closing the inclined opening.

5 Claims, 3 Drawing Sheets

DOWNCOMER AND FLAPPER VALVE

BACKGROUND OF THE INVENTION

This invention relates to a new and improved downcomer and flapper valve particularly useful for transferring overflow particles from an upper fluidized bed of particles to a lower fluidized bed of particles.

The downcomer and flapper valve of the present invention may be incorporated into apparatus for practicing the NOXSO Process disclosed in U.S. Pat. No. 4,798,711 entitled PROCESS FOR REMOVING NITROGEN OXIDES, SULFUR OXIDES AND HYDROGEN SULFIDE FROM GAS STREAMS, patented Jan. 17, 1989, Lewis G. Neal, et al., inventors, and assigned to the same assignee as the present invention; this patent is hereby incorporated herein by reference and will be referred to hereinafter as the "'711 patent." Generally, the NOXSO Process disclosed in the '711 patent uses $SO_x$ and $NO_x$ from gas streams particularly coal combustion flue gas. alumina sorbent beads or particles for the removal by adsorption of As illustrated in FIG. 3 of the '711 patent, the sorbent particles contact the flue gas in the adsorber 14 having a fluidizing bed 15 and the $SO_x$ and $NO_x$ in the flue gas are adsorbed onto the surface of the sorbent particles and thereby removed from the flue gas. Sorbent particles loaded with the $SO_x$ and $NO_x$ are transported to a multi stage fluid bed heater 18 where the loaded sorbent particles are contacted by hot air to remove or strip the $NO_x$ from the particles. Thereafter, the sorbent particles now having only the $SO_x$ adsorbed thereto are transported to a moving bed regenerator 32 where the sorbent particles are contacted with a regenerant gas stream 36 which reacts with the adsorbed $SO_x$ to produce elemental sulfur contained in the off-gas stream 38. Subsequently, the sorbent particles are transported to a multi-stage fluid bed sorbent cooler 52 where the sorbent particles are contacted with cooled air to reduce the temperature of the previously heated particles. The sorbent particles have then been regenerated and the $SO_x$ and $NO_x$ adsorption removal process is repeated.

FIG. 1 is a diagrammatical illustration of a prior art multi-stage fluid bed heater which may be utilized at the multi-stage fluid bed heater 18 shown in FIG. 3 of the '711 patent. The multi-stage fluid bed heater shown in FIG. 1 provides three beds of fluidized sorbent particles, 21, 22 and 23 residing above perforated metal fluidizing grids 25, 26 and 27 and disposed vertically in the metal vessel 30; the perforated metal fluidizing grids 25, 26 and 27 are suitably secured to the metal vessel 30 such as by belting or welding. The sorbent particles enter the top portion of the vessel 30 as indicated by the arrow 32. Hot air, as indicated by the arrow 33, enters the bottom of the vessel 30 and flows upwardly through each of the three fluidized beds of sorbent particles 21, 22 and 23 to remove or strip the $NO_x$ from the sorbent particles which $NO_x$ exits the vessel 30 in a gas stream indicated by the arrow 34. Tubular metal overflow pipes 36 and 38 are mounted to and extend upwardly from the fluidizing grids 25 and 26 and tubular metal downcomers 40 and 42 are suitably mounted to and extend vertically downwardly from the fluidizing grids 25 and 26. For example, the overflow pipe 36 and downcomer 40 are coextensive tubular members and may either be formed separately and suitably joined or may be a single tubular member. In operation, sorbent particles in the fluidized bed 21 in excess of the height of the overflow pipe 36 flow into and downwardly through the overflow pipe and further downwardly through the downcomer 40 and into the fluidized bed 22. Sorbent particles in excess of the height of the overflow pipe 38 flow into and downwardly through the overflow pipe and downwardly through the downcomer 42 into the fluidized bed 23. Sorbent particles are removed from the bottom fluidized bed 23 utilizing a flow controlled L-valve 44, of the type known to the art, and are removed at a rate sufficient to maintain a constant level in the bottom fluidized bed 23; sorbent particles exit the vessel 30 through the L-valve 44 as indicated by the arrow 45. It will be further noted from FIG. 1 that the downcomers 40 and 42 extend downwardly into the fluidized beds 22 and 23 and that the bottoms of the downcomers 40 and 42 open into the bodies of the fluidized beds of sorbent particles 22 and 23.

Each downcomer 40 and 42 is provided with a flapper valve 50 which may be of the type shown in FIGS. 2A through 2C. It will be generally understood that the flapper valves 50 are closed when no sorbent particles are flowing downwardly from an upper bed to a lower bed and that the flapper valves 50 prevent air flow back through the downcomers when the downcomers are not full of sorbent particles. This condition occurs on start-up when the sorbent particles reside above the fluidizing grids and have not yet been fluidized. If the flapper valves 50 were not present at the bottoms of the downcomers sufficient air would flow through the downcomer such that the sorbent particles residing above the fluidizing grids would not fluidize and the beds would not fill with sorbent particles. The flapper valve 50 includes a rectangular tubular member 51 including a tapered lower portion 52 provided with a vertical opening 54 better seen in vertical cross-section in FIG. 2C. A flapper valve 56 is mounted pivotally at 57 to the downcomer 50 at a position to cause the flapper valve 56 to engage the downcomer and normally close the opening 54. It has been found that the prior art flapper valve 56 has at least three major limitations. The flapper valve 56 tends to hang open allowing gas flow up through the downcomer to which it is mounted thereby preventing sorbent particle flow. Secondly, the vertically oriented opening 54 requires the sorbent particles to flow horizontally out of the downcomer. This horizontal flow, combined with the relatively small cross-sectional area of the opening or outlet 54, limits the maximum flow rate of sorbent particles through the downcomer. Finally, it has been found that flow stops through the downcomer 50 if the level of the fluidized bed into which the bottom portion of the downcomer 50 extends rises to the top of the flapper valve 56 where the flapper valve is mounted pivotally to the downcomer 50; in this condition, the flapper valve substantially ceased to open and flow of sorbent particles out of the opening 54 was prevented.

Accordingly, there exists a need in the art for a new and improved downcomer and flapper valve which provides improved performance and overcomes the above-noted limitations associated with the prior art flapper valves of the type shown in FIGS. 2A–2C.

SUMMARY OF THE INVENTION

It is the object of the present invention to satisfy the foregoing need in the art.

A new and improved downcomer and flapper valve satisfying the foregoing need and embodying the present invention may include a downcomer including a tubular member oriented vertically and extending downwardly from a fluidized grid and including a lower portion provided with an inclined opening formed at a first angle with respect to the tubular member, and a flapper valve including an upper portion and a lower portion formed at a second angle with respect to the upper flapper valve portion, the upper portion of the flapper valve is mounted pivotally to the tubular member at a position to normally place the lower portion of the flapper valve in engagement with and closing the inclined opening.

DESCRIPTION OF THE PREFERRED EMBODIMENT

Figure 3A:
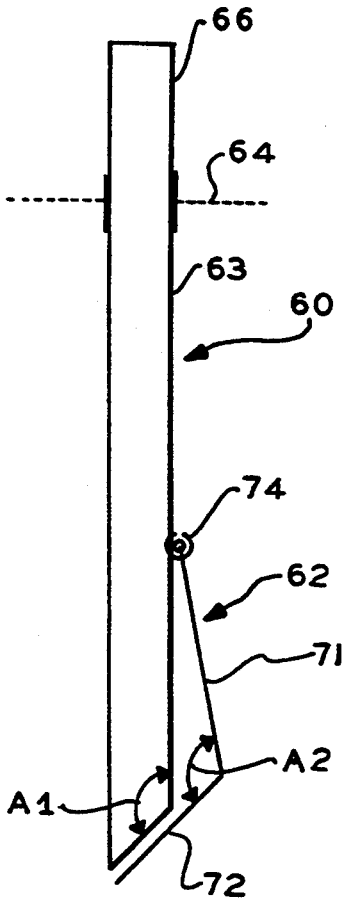
FIG. 3A is a side view of a downcomer and flapper valve embodying the present invention.
Figure 3B:
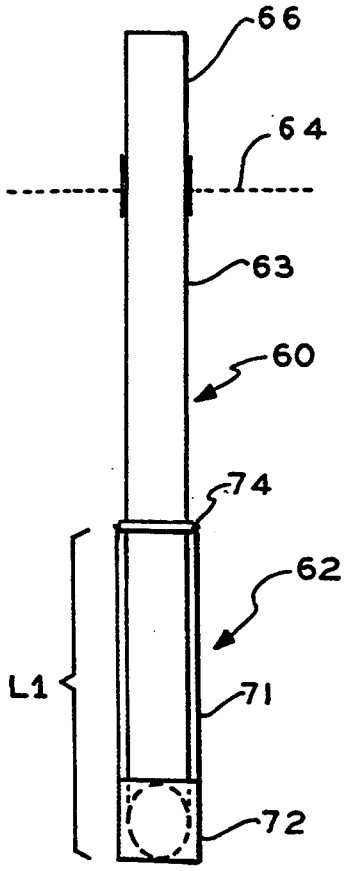
FIG. 3B is a front view of the structure shown in FIG. 3A.
Figure 3C:
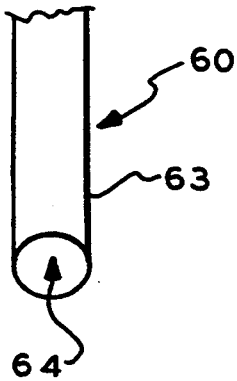
FIG. 3C is a partial front view of the downcomer shown in FIGS. 3A and 3B showing the inclined opening formed at the bottom of the downcomer.
Figure 4:
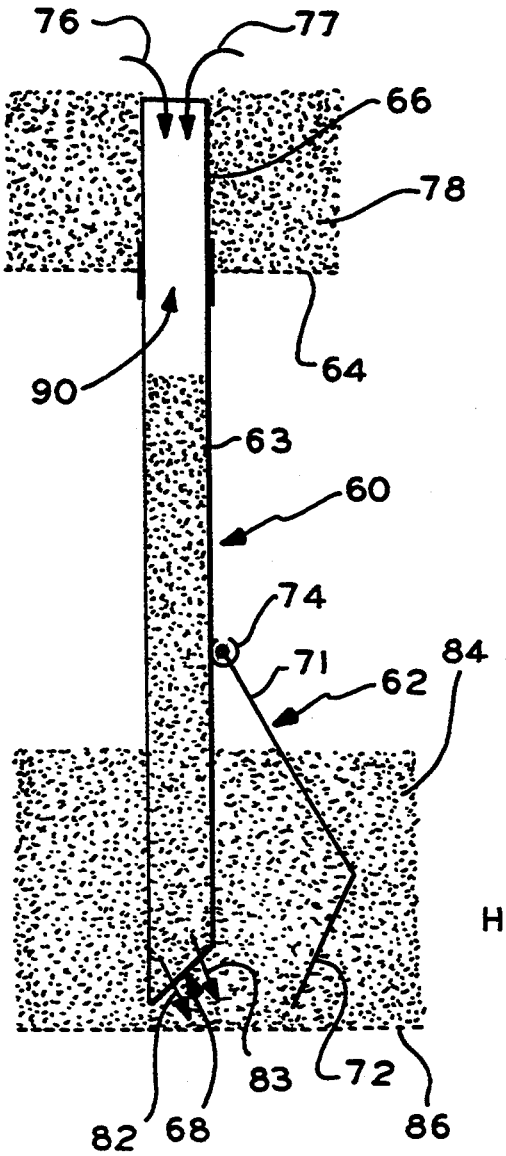
FIG. 4 is a vertical diagrammatical illustration of the downcomer and flapper valve of the present invention in the open position.
Figure 5:
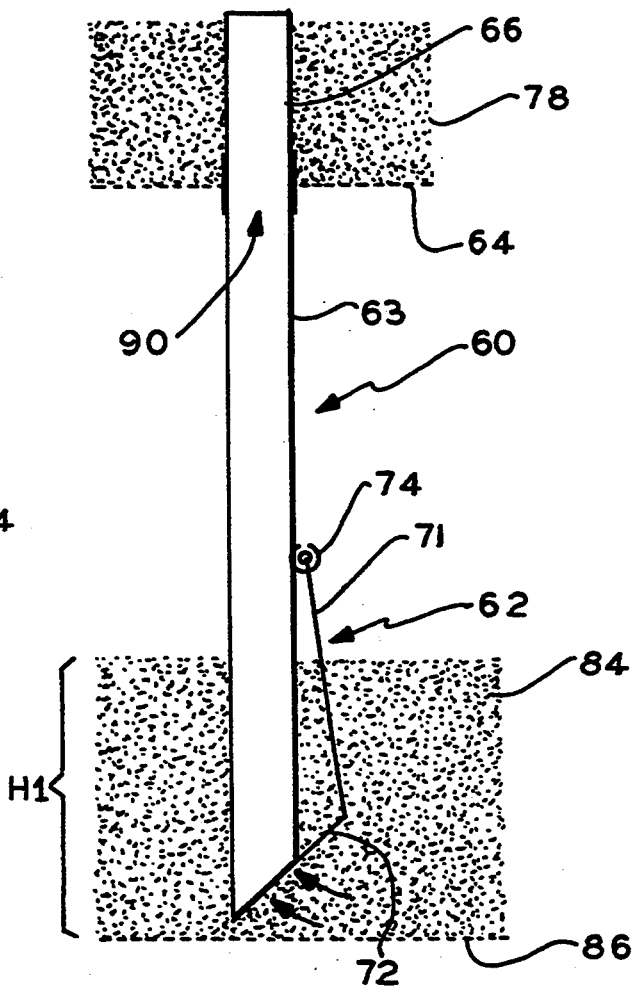
FIG. 5 is a vertical diagrammatical illustration of the downcomer and flapper valve of the present invention with the flapper valve shown in the closed position.

Referring to FIGS. 3–5, and in particular to FIGS. 3A–3C, a downcomer embodying the present invention is indicated by general numerical designation 60 and a flapper valve embodying the present invention is indicated by general numerical designation 62. The downcomer 60 includes a tubular member 63 mounted suitably to and extending vertically downwardly from a fluidizing grid such as the perforated plate 64. Extending upwardly from the downcomer 60 is a suitable overflow pipe 66 which is tubular and coextensive with the downcomer 60. The overflow pipe 66 is also suitably mounted to and extends vertically upwardly from the fluidizing grid 64.

As may best be understood from FIG. 3C, the lower portion of the tubular member 61 is cut at an angle to provide an inclined opening indicated by general numerical designation 68 formed at an angle A1 with respect to the tubular member 63. In the preferred embodiment, the angle A1 was about 45°.

The flapper valve 62 of the present invention includes a straight upper portion 71 and a straight lower portion 72 formed at an angle A2 with respect to the upper portion 71. The top of the upper flapper valve portion 71 is mounted pivotally to the tubular member 63 of the downcomer 60 by the pivot 74. It will be understood that in the normal condition, due to the weight of the flapper valve 62 and gravity, the lower portion 72 of the flapper valve normally engages and closes the downcomer inclined opening 68.

Figure 1:
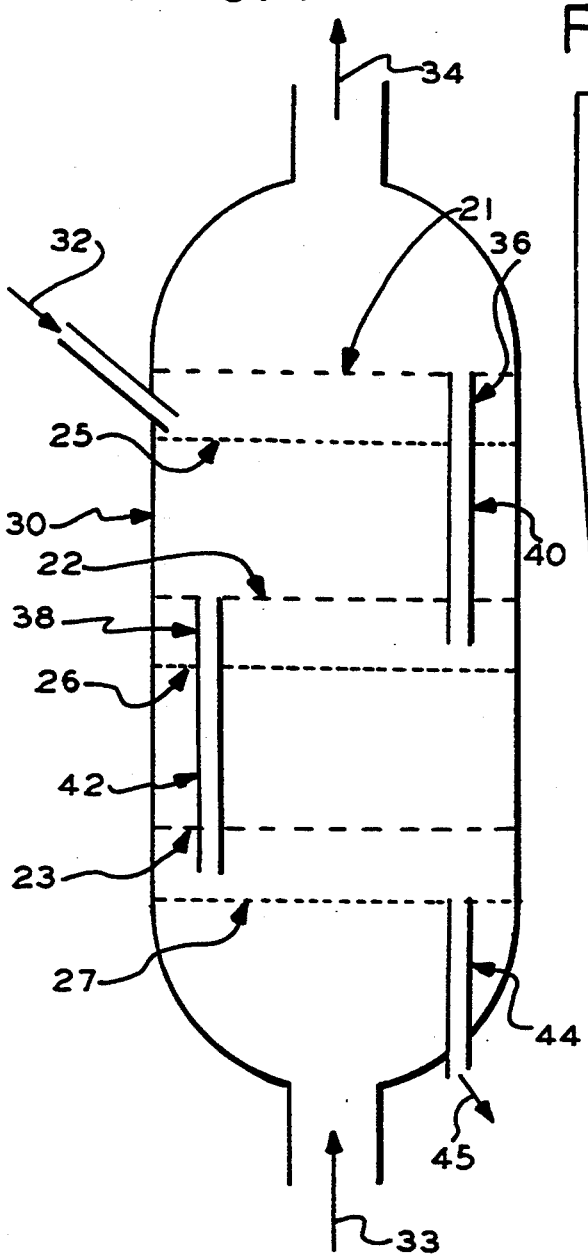
FIG. 1 PRIOR ART
FIG. 1 is a vertical, diagrammatical illustration of a prior art multi-stage fluid bed heater.
Figure 2A:
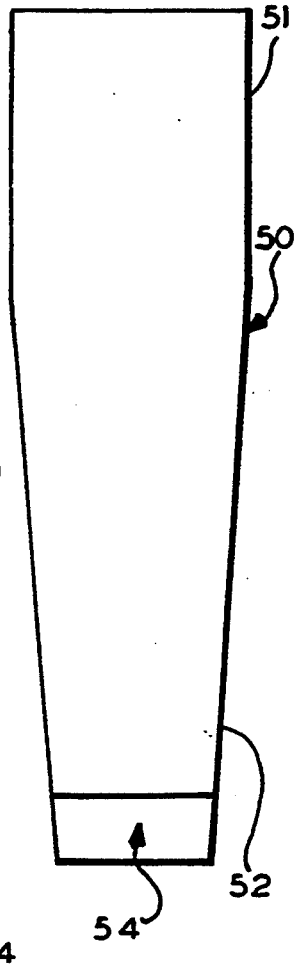
FIG. 2A is a front view of a prior art downcomer.
Figure 2B:
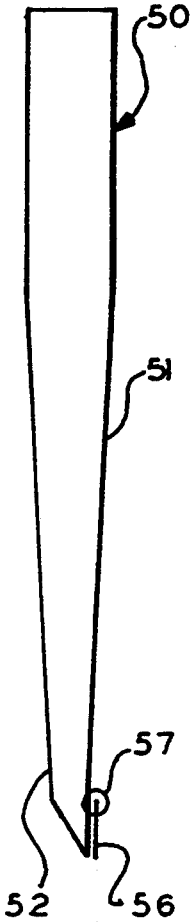
FIG. 2B is a side view of the prior art downcomer shown in FIG. 2A having a prior art flapper valve mounted pivotally thereto.
Figure 2C:
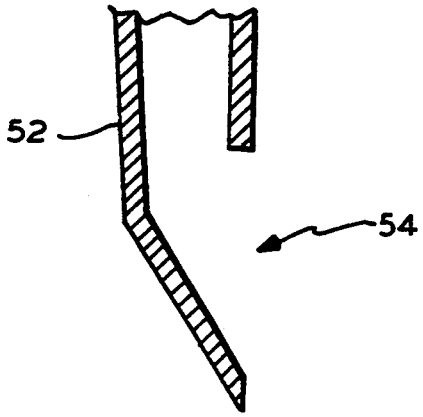
FIG. 2C is a partial vertical cross-sectional view of the lower portion of the downcomer shown in FIGS. 2A and 2B.

Referring to FIGS. 4 and 5, as indicated by the arrows 76 and 77, excess sorbent particles in the upper fluidized bed 78 residing above the fluidized bed 64 flow into and downwardly through the overflow pipe 66 and into the downcomer 60 until the weight of the sorbent particles in the downcomer provide a force sufficiently great to push against the lower portion 72 of the flapper valve 62 to cause the valve to open and permit sorbent particles, as indicated by the arrows 82 and 83, to flow into the lower fluidized bed of sorbent particles 84 residing above the fluidizing grid 86. When the flow of sorbent particles downwardly through the downcomer 60 stops, the positive pressure differential between the outlet of the downcomer 60 provided by the inclined opening 68 and the downcomer inlet, indicated by general numerical designation 90 in FIGS. 4 and 5, pushes the flapper valve closed as shown in FIG. 5 and forces the lower portion 72 of the flapper valve 62 into engagement with the lower portion of the tubular member 63 thereby closing the inclined opening 68. When sufficient sorbent particles have again refilled the downcomer 60, the weight of such sorbent particles again opens the flapper valve 62 and pushes the lower portion 72 of the flapper valve open into the position shown in FIG. 4 and the cycle is repeated. It has been found that the downcomer 60 and flapper valve 62 of the present invention solves the above-noted prior art problems associated with prior art downcomers and flapper valves of the type shown in FIGS. 2A–2C by providing a direct downward flow of the sorbent particles through the downcomer. It has been found that this vertical flow achieves much higher sorbent particle flow rates through the downcomer than with the prior art downcomer and flapper valve shown in FIGS. 2A–2C. Further, the entire cross-sectional area of the downcomer 60 is available for downward sorbent particle flow.

A further novel feature of the flapper valve of the present invention will be understood by reference to FIGS. 3B and 5 wherein it will be noted that the top of the upper portion 71 of the flapper valve 60 is mounted by the pivot 74 to the downcomer 60 at a point above the maximum sorbent bed height H1 (FIG. 5) of the lower fluidized bed 84 into which the bottom portion of the downcomer 60 extends. It has been discovered that by mounting the upper portion of the flapper valve 71 pivotally to the downcomer 60 at a point above the maximum sorbent bed height H1 (FIG. 5) of the fluidized bed 84 into which the downcomer extends, the flapper valve continues to function unlike the above-noted prior art flapper valve 56 (FIGS. 2A–2C) which, as noted above, ceases to function if the level of the fluidized bed into which the bottom portion of the prior art downcomer 50 extends rises above the point at which the flapper valve 56 is mounted pivotally to the downcomer, e.g. downcomer 50 of FIGS. 2A–2C. More particularly, in the present invention the overall length L1 (FIG. 3B) of the downcomer 60, or the combined effective vertical lengths of the downcomer upper and lower portions 71 and 72, is greater than the maximum height H1 (FIG. 5) of the fluid bed 84 into which the downcomer extends rises above the point at which the flapper valve 56 is mounted pivotally to the downcomer, e.g. downcomer 50 of FIGS. 2A–2C. More particularly, in the present invention the overall length L1 (FIG. 3b) of the downcomer 60, or the combined effective vertical lengths of the downcomer upper and lower portions 71 and 72, is greater than the maximum height H1 (FIG. 5) of the fluid bed 84 into which the downcomer extends.

It will be understood that many variations and modifications may be made in the present invention without departing from the spirit and the scope thereof.

What is claimed is:

1. Improved downcomer and flapper valve, comprising:

a tubular member oriented vertically and including a lower portion provided with an inclined opening formed at a first angle with respect to said vertical tubular member; and a flapper valve including an upper portion and a lower portion formed in a second angle with respect to said upper portion, said upper portion of said flapper valve mounted pivotally to said tubular member at a position to normally place said lower portion of said flapper valve in engagement with and closing said inclined opening.

2. The downcomer and flapper valve according to claim 1 wherein said first angle is about 45° and wherein said second angle is about 135°.

3. Improved downcomer and flapper valve particularly useful for being mounted vertically to and extending downwardly from an upper fluidizing grid and for transferring overflow particles from a fluidized bed of particles residing above said upper fluidizing grid downwardly to a lower fluidized bed of particles residing above a lower fluidizing grid, comprising:

a tubular member mounted to and extending vertically downwardly from said upper fluidizing grid and including a lower portion provided with an inclined opening formed at a first angle with respect to said vertical tubular member; and a flapper valve including an upper portion and a lower portion formed at a second angle with respect to said upper portion, said upper portion of said flapper valve mounted pivotally to said tubular member at a position to normally place said lower portion of said upper valve in engagement with and closing said inclined opening.

4. The downcomer and flapper valve according to claim 3 wherein said first angle is about 45° and wherein said second predetermined angle is about 135°.

5. The downcomer and flapper valve according to claim 3 wherein said lower fluidized bed of particles has a maximum height and wherein said flapper valve has a length sufficiently long to cause said position at which said upper portion of said flapper valve is mounted pivotally to said tubular member to reside above said maximum height of said lower fluidized bed of particles.

* * * * *